US009377000B2

(12) United States Patent
Skinner et al.

(10) Patent No.: US 9,377,000 B2
(45) Date of Patent: Jun. 28, 2016

(54) IGNITION COIL

(71) Applicants: Albert A. Skinner, Waterford, MI (US); Harry O. Levers, Clarkston, MI (US); Andre V. Scaff, Lake Orion, MI (US); Jose J. Galicia, Cd. Juarez (MX)

(72) Inventors: Albert A. Skinner, Waterford, MI (US); Harry O. Levers, Clarkston, MI (US); Andre V. Scaff, Lake Orion, MI (US); Jose J. Galicia, Cd. Juarez (MX)

(73) Assignee: Delphi Technologies, Inc., Troy, MI (US)

( * ) Notice: Subject to any disclaimer, the term of this patent is extended or adjusted under 35 U.S.C. 154(b) by 828 days.

(21) Appl. No.: 13/713,056

(22) Filed: Dec. 13, 2012

(65) Prior Publication Data

US 2014/0165978 A1 Jun. 19, 2014

(51) Int. Cl.

| | |
|---|---|
| ***F02P 1/08*** | (2006.01) |
| ***F02P 3/04*** | (2006.01) |
| ***F02P 15/08*** | (2006.01) |
| ***H01F 38/12*** | (2006.01) |

(52) U.S. Cl.

CPC . *F02P 1/083* (2013.01); *F02P 3/04* (2013.01); *F02P 15/08* (2013.01); *H01F 38/12* (2013.01)

(58) Field of Classification Search

CPC ..... F02P 15/08; F02P 15/02; F02P 1/083; F02P 3/04; H01F 38/12

USPC ..... 123/605, 618, 621, 634, 635, 636, 638; 361/253, 254, 263; 336/90, 92, 107, 336/192

See application file for complete search history.

(56) References Cited

U.S. PATENT DOCUMENTS

| | | | | | |
|---|---|---|---|---|---|
| 4,649,881 | A * | 3/1987 | Long | F02P 7/035 | 123/406.63 |
| 4,805,570 | A * | 2/1989 | Davis | H01T 13/462 | 123/169 EL |
| 5,261,367 | A * | 11/1993 | Yamamoto | F02B 23/08 | 123/309 |
| 5,269,270 | A * | 12/1993 | Suzuki | F01L 1/267 | 123/193.5 |
| 6,035,838 | A * | 3/2000 | Tozzi | F02P 3/053 | 123/618 |
| 6,556,118 | B1 | 4/2003 | Skinner | | |
| 6,860,256 | B2 * | 3/2005 | Nakamura | F02P 3/02 | 123/621 |
| 7,148,780 | B2 * | 12/2006 | Skinner | F02P 15/08 | 123/634 |
| 7,268,655 | B2 * | 9/2007 | Skinner | H01F 27/367 | 336/90 |
| 7,332,991 | B2 * | 2/2008 | Skinner | F02P 3/02 | 123/634 |
| 7,677,230 | B2 * | 3/2010 | Meyer | F02P 15/04 | 123/605 |
| 7,796,004 | B2 * | 9/2010 | Matsubayashi | H01F 27/022 | 123/634 |
| 7,849,843 | B2 * | 12/2010 | Kojima | H01F 38/12 | 123/635 |
| 2004/0194769 | A1 * | 10/2004 | Nakamura | F02P 3/02 | 123/621 |
| 2006/0164196 | A1 * | 7/2006 | Skinner | F02P 15/08 | 336/90 |
| 2007/0209645 | A1 * | 9/2007 | Skinner | F02P 3/02 | 123/620 |
| 2009/0205621 | A1 | 8/2009 | Skinner et al. | | |
| 2013/0128401 | A1 * | 5/2013 | Tsaur | H04B 3/00 | 361/56 |

* cited by examiner

*Primary Examiner* — Erick Solis
*Assistant Examiner* — Carl Staubach
(74) *Attorney, Agent, or Firm* — Joshuam Haines

(57) ABSTRACT

An ignition coil for an internal combustion engine includes a magnetically-permeable core a primary winding disposed outward of the core, and a secondary winding disposed outward of the primary winding and inductively coupled to the primary winding. The secondary winding has a left secondary winding section and right secondary winding section. A first end of the left secondary winding section is in electrical contact with a first terminal for delivering a first spark-generating current to a first spark plug. A first end of the right secondary winding section is in electrical contact with a second terminal for delivering a second spark-generating current to a second spark plug. A second end of the first secondary winding and a second end of a the second secondary winding is connected to a third terminal for delivering a third spark-generating current to a third spark plug.

13 Claims, 3 Drawing Sheets

IGNITION COIL

TECHNICAL FIELD OF INVENTION

The present invention relates to an ignition coil for developing a spark firing voltage, more particularly to such an ignition coil for developing a spark firing voltage that is applied to three spark plugs of a single combustion chamber of an internal combustion engine.

BACKGROUND OF INVENTION

Internal combustion engine manufactures strive to produce engines which produce low levels of harmful exhaust emissions and high levels of fuel economy. In doing so, it may be beneficial to run the engine on a mixture which includes a very lean air/fuel ratio as well high levels of exhaust gas recirculation (EGR) that are to be ignited in the combustion chamber. Strategies are being investigated by engine manufactures to increase the capability of the ignition systems of the engines to reliably ignite the mixture in each combustion chamber. One strategy is to increase the number of ignition sites within each combustion chamber. Historically, only one spark plug has been provided for igniting the mixture in each combustion chamber. More recently, two spark plugs have been provided in some engines for igniting the mixture in each combustion chamber. In order to provide a spark-generating current to each of the two spark plugs in a single combustion chamber, each spark plug may be provided with its own distinct ignition coil. Alternatively, a single ignition coil as shown in U.S. Pat. No. 7,148,780 which is commonly assigned and incorporated herein by reference in its entirety may be used to provide a spark-generating current to both spark plugs. While two spark plugs per combustion chamber may be sufficient for some applications, current developments have led to configurations that require three spark plugs per combustion chamber. The conventional approach to providing a spark-generating current to each of the three spark plugs is to provide each of the three spark plugs with its own distinct ignition coil. However, due to packaging size, controller requirements, and costs associated with three distinct ignition coils, it may be desirable to provide a single ignition coil that provides a spark-generating current to each of the three spark plugs.

What is needed is an ignition coil which provides a spark-generating current to three spark plugs of a single combustion chamber of an internal combustion engine.

SUMMARY OF THE INVENTION

Briefly described, an ignition coil for an internal combustion engine is provided. The ignition coil includes a magnetically-permeable core, a primary winding disposed outward of the core, and a secondary winding disposed outward of the primary winding and inductively coupled to the primary winding. The secondary winding has a left secondary winding section and right secondary winding section. A first end of the left secondary winding section is in electrical contact with a first terminal for delivering a first spark-generating current to a first spark plug. A first end of the right secondary winding section is in electrical contact with a second terminal for delivering a second spark-generating current to a second spark plug. A second end of the first secondary winding and a second end of the second secondary winding is in electrical contact with a third terminal for delivering a third spark-generating current to a third spark plug.

BRIEF DESCRIPTION OF DRAWINGS

This invention will be further described with reference to the accompanying drawings in which.

DETAILED DESCRIPTION OF INVENTION

Figure 1:
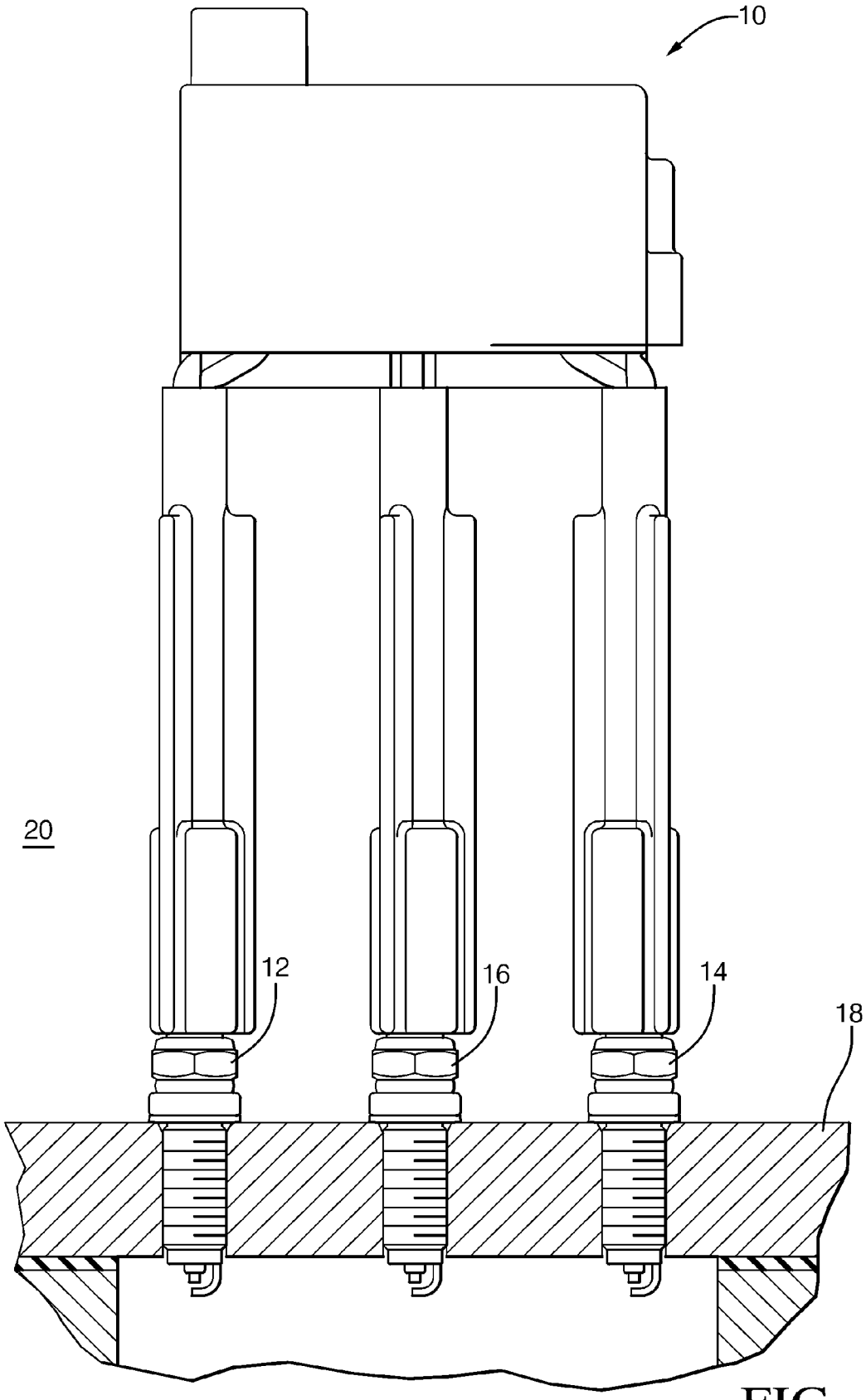
FIG. 1 is an elevation view of an ignition coil in accordance with the present invention connected to three spark plugs of a single combustion chamber of an internal combustion engine.

Referring now to the drawings wherein like reference numerals are used to identify identical components in the various views, FIG. 1 is an elevation view of an ignition coil 10 in accordance with the present invention. Ignition coil 10 is configured for connection to spark plugs 12, 14, 16 that are each in threaded engagement with respective spark plug openings of a single combustion chamber 18 of an internal combustion engine 20. Combustion chamber 18 receives a mixture of fuel and air where the mixture of fuel and air is compressed and ignited. Ignition coil 10 is configured to output a high-voltage (HV) spark-generating current to each spark plug 12, 14, 16, as shown.

Figure 2:
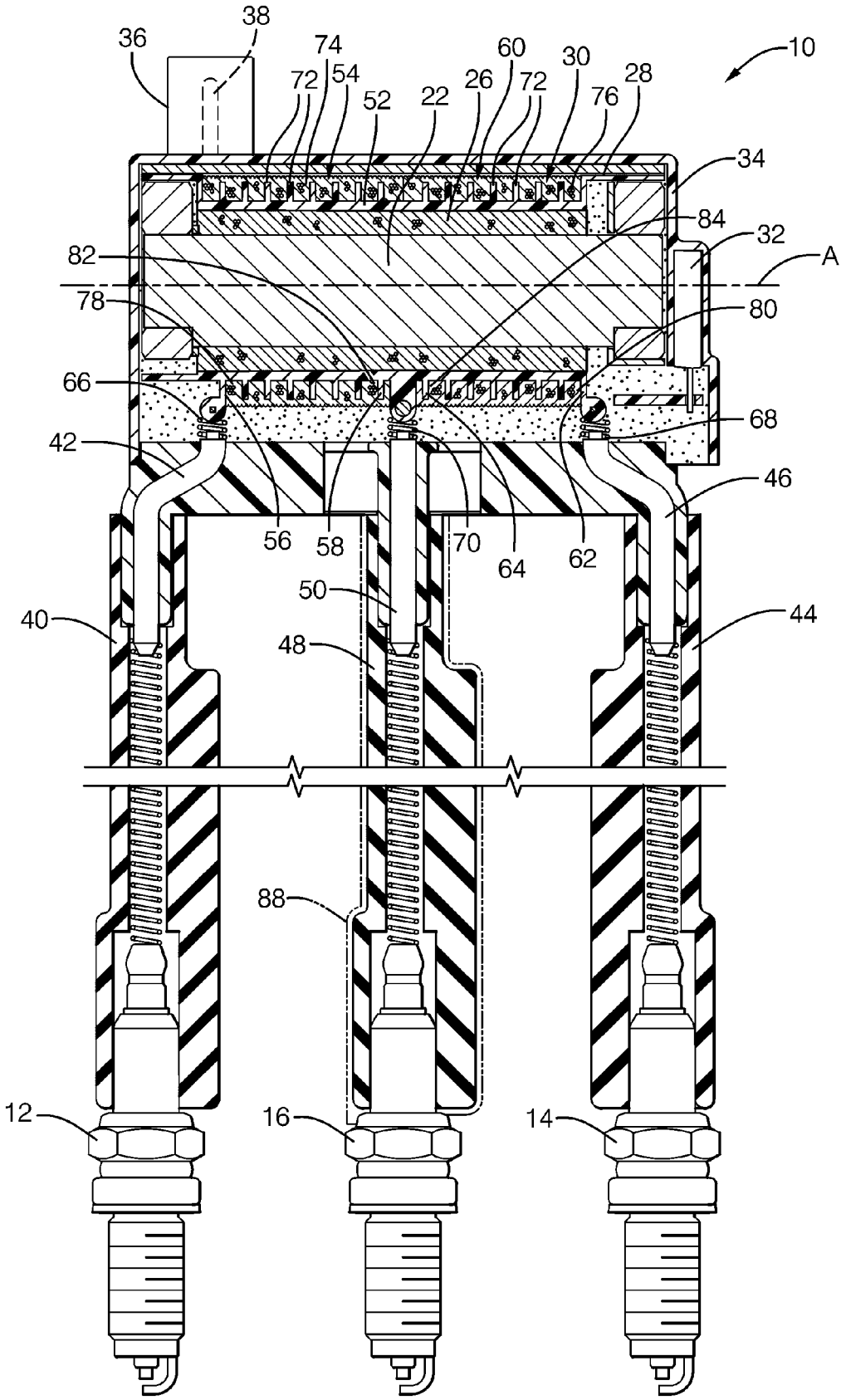
FIG. 2 is a simplified cross-sectional view of a portion of the ignition coil of FIG. 1.

Reference will now be made to FIG. 2 which is a cross-section view of ignition coil 10. Ignition coil 10 may include a magnetically-permeable core 22, a primary winding 26, a secondary winding spool 28, a secondary winding 30, a quantity of encapsulant 32 such as an epoxy potting material, a case 34, a low-voltage (LV) connector body 36 having primary terminals 38 (only one primary terminal 38 is visible), a first HV tower 40 having a first HV terminal 42, a second HV tower 44 having a second HV terminal 46, and a third HV tower 48 having a third HV terminal 50. First HV tower 40 is provide for connection to spark plug 12, second HV tower 44 is provided for connection to spark plug 14, and third HV tower 48 is provided for connection to spark plug 16.

With continued reference to FIG. 2, core 22 extends along a core longitudinal axis A. Core 22 may be made of a laminated steel plates, compression molded insulated iron particles, or other appropriate material.

Primary winding 26, is wound onto core 22 as a continuous winding and may be electrically insulated from core 22 as is known in the art, for example, by surrounding core 22 with an insulating heat-shrink material. Primary winding 26 includes first and second ends that are connected to primary terminals 38 in LV connector body 36. Primary winding 26 is configured to carry a primary current for charging ignition coil 10. Primary winding 26 may comprise copper, insulated magnet wire, with a size typically between about 20-23 AWG.

Secondary winding spool 28 is configured to receive and retain secondary winding 30. Secondary winding spool 28 is disposed adjacent to and radially outward of the central components comprising core 22, and primary winding 26 and, preferably, is in coaxial relationship therewith. Secondary winding spool 28 includes a generally cylindrical body 52 having a left winding bay 54 that is bounded by a first pair of retaining flanges 56, 58. Secondary winding spool 28 also includes a right winding bay 60 that is bounded by a second pair of retaining flanges 62, 64. It should be understood that the terms left and right are only relative to orientation of left winding bay 54 and right winding bay 60 as shown in the figures. Secondary winding spool 28 also includes a first terminal 66, a second terminal 68, and third terminal 70. In the illustrated embodiment, secondary winding spool 28 is configured for use with a segmented winding strategy where a plurality of axially spaced ribs 72 are disposed between retaining flanges 56, 58 and between retaining flanges 62, 64 to form a plurality of channels therebetween for accepting secondary winding 30. However, it should be understood that other known configurations may be employed, such as, for example only, a configuration adapted to receive one continuous secondary winding in each of left winding bay 54 and right winding bay 60, e.g. progressive winding. Secondary winding spool 28 may be formed generally of electrical insulating material having properties suitable for use in a relatively high temperature environment. For example, secondary winding spool 28 may comprise plastic material such as PPO/PS (e.g., NORYL available from General Electric) or polybutylene terephthalate (PBT) thermoplastic polyester. It should be understood that there are a variety of alternative materials that may be used for secondary winding spool 28.

Secondary winding 30 includes a left secondary winding section 74 and a right secondary winding section 76. It should be understood that the terms left and right are only relative to orientation of left secondary winding section 74 and right secondary winding section 76 as shown in the figures. Left secondary winding section 74 is disposed within left winding bay 54 while right secondary winding section 76 is disposed within right winding bay 60. As shown, right secondary winding section 76 is coaxial to left secondary winding section 74 and right secondary winding section 76 is axially spaced from left secondary winding section 74. Left secondary winding section 74 has a first end 78 that is proximal to retaining flange 56 and in electrical contact with first terminal 66. Similarly, right secondary winding section 76 has a first end 80 that is proximal to retaining flange 62 and in electrical contact with second terminal 68. Left secondary winding section 74 and right secondary winding section 76 have second ends 82, 84 respectively which are both connected to third terminal 70. Left secondary winding section 74 may be wound either clockwise or counterclockwise around secondary winding spool 28 while right secondary winding section 76 is wound in the opposite direction.

Encapsulant 32 may be suitable for providing electrical insulation within ignition coil 10. In a preferred embodiment, encapsulant 32 may comprise an epoxy potting material. Sufficient encapsulant 32 is introduced in ignition coil 10, in the illustrated embodiment, to substantially fill the interior of case 34. Encapsulant 32 also provides protection from environmental factors which may be encountered during the service life of ignition coil 10. There are a number of encapsulant materials known in the art.

Figure 3:
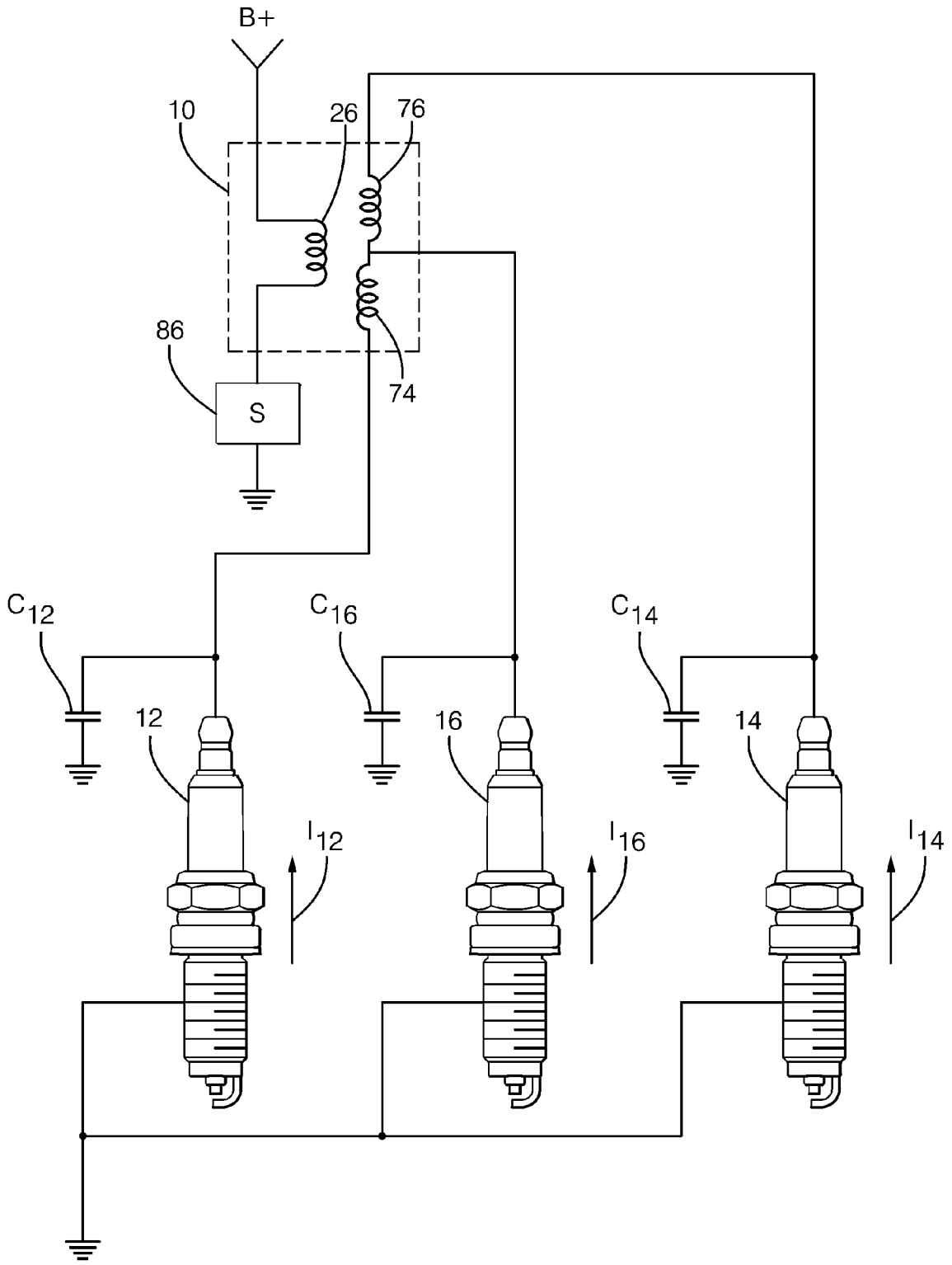
FIG. 3 is a simplified schematic and block diagram, in electrical form, of the ignition coil of FIGS. 1 and 2.

Reference will now be made to FIG. 3 which is a simplified schematic and block diagram, in electrical form, of ignition coil 10 of FIGS. 1 and 2. A switch 86 is provided for operation of ignition coil 10. Closing switch 86 establishes a path to ground through primary winding 26. When switch 86 is thereafter opened, the current through primary winding 26 is interrupted, thereby causing a relatively high voltage to be produced across left secondary winding section 74 and right secondary winding section 76. This high voltage is applied to spark plugs 12, 14, 16. If capacitance $C_{12}$≈capacitance $C_{14}$≈capacitance $C_{16}$ and left secondary winding section 74 has approximately the same number of turns as right secondary winding section 76, then current $I_{12}$≈current $I_{14}$, current $I_{16}$≈2× current $I_{12}$, and current $I_{16}$≈2× current $I_{14}$. Since $I_{16}$≈2× current $I_{12}$ and current $I_{14}$, the relatively high voltage at third HV terminal 50 will be reached in half the time than the relatively high voltage at first HV terminal 42 and second HV terminal 46. Consequently, a spark will be generated at spark plug 16 earlier that at spark plugs 12, 14. Also consequently, the energy delivered to spark plug 16 by current $I_{16}$ will be about double the energy delivered to spark plug 12 by current $I_{12}$. Similarly, the energy delivered to spark plug 16 by current $I_{16}$ will be about double the energy delivered to spark plug 14 by current $I_{14}$. It should be noted that the polarity of spark plugs 12 and 14 will be the opposite of spark plug 16.

Capacitance $C_{16}$ may be increased if there is a desire for $I_{16}$ to be approximately equal to $I_{12}$ and $I_{14}$, for example, to alter ignition characteristics within combustion chamber 18. Increasing capacitance $C_{16}$ may be accomplished, for example, by adding a cylindrical ground plane 88, shown in FIG. 2 as a phantom line, associated with third HV terminal 50 which is connected to spark plug 16 to provide a ground. Ground plane 88, as shown, radially surrounds third HV tower 48. Increasing capacitance $C_{16}$ such that capacitance $C_{16}$≈2× capacitance $C_{12}$ and capacitance $C_{16}$≈2× capacitance $C_{14}$ will cause current $I_{12}$≈current $I_{14}$≈current $I_{16}$, and consequently, sparks will generated at spark plugs 12, 14, 16 at approximately the same time. While ground plane 88 has been illustrated as optionally being applied to third HV tower 48, it should now be understood that ground plane 88 may be alternatively, or in addition to, be applied to first HV tower 40 and/or second HV tower 44 to achieve ignition characteristics within combustion chamber 18.

Ignition characteristics within combustion chamber 18 may also be altered by providing left secondary winding section 74 with a different number of turns than right secondary winding section 76. Providing left secondary winding section 74, for example, with fewer windings than right secondary winding section 76 will make current $I_{12}$<current $I_{14}$. Consequently, the energy delivered to spark plug 12 by current $I_{12}$ will be less than the energy delivered to spark plug 14 by current $I_{14}$.

While ignition coil 10 has been illustrated with first HV terminal 42 connected to spark plug 12, second HV terminal 46 connected to spark plug 14, and third HV terminal 50 being connected to spark plug 16, it should now be understood that HV terminals 42, 46, 50 could alternatively be connected to spark plugs 12, 14, 16 in a different arrangement. In one example, first HV terminal 42 may be connected to spark plug 16 and third HV terminal 50 may be connected to spark plug 12. This may be accomplished with conductors internal to ignition coil 10. This may be desirable, for example to position the spark plug that will receive the highest energy at a position that is not between the two remaining spark plugs.

While this invention has been described in terms of preferred embodiments thereof, it is not intended to be so limited, but rather only to the extent set forth in the claims that follow.

We claim:

1. An ignition coil for an internal combustion engine having a combustion chamber with a first spark plug, a second spark plug, and a third spark plug;

said ignition coil comprising:

a magnetically-permeable core;

a primary winding disposed outward of said core; and a secondary winding disposed outward of said primary winding and inductively coupled to said primary winding, said secondary winding having a left secondary winding section and a right secondary winding section;

wherein one end of said left secondary winding section is in electrical contact with a first terminal for delivering a first spark-generating current to said first spark plug, wherein one end of said right secondary winding section is in electrical contact with a second terminal for delivering a second spark-generating current to said second spark plug, and wherein the other end of said left secondary winding section and the other end of said right secondary winding section are connected to a third terminal for delivering a third spark-generating current to said third spark plug.

2. An ignition coil as in claim 1 wherein said third terminal is located between said first terminal and said second terminal.

3. An ignition coil as in claim 1 wherein said left secondary winding section is wound in one of a clockwise direction and a counterclockwise direction around said right secondary winding section is wound in the opposite direction of said left secondary winding section.

4. An ignition coil as in claim 1 wherein said first spark-generating current has the same polarity as said second spark-generating current.

5. An ignition coil as in claim 1 wherein said first spark-generating current has the opposite polarity as said third spark-generating current.

6. An ignition coil as in claim 5 wherein said second spark-generating current has the opposite polarity as said third spark-generating current.

7. An ignition coil as in claim 1 wherein said secondary winding is wound around a secondary winding spool that is disposed outward of said primary winding.

8. An ignition coil as in claim 7 wherein said secondary winding spool has a left winding bay for receiving said left secondary winding section and a right winding bay for receiving said right secondary winding section.

9. An ignition coil as in claim 8 wherein said left winding bay and said right winding bay each include a plurality of axially spaced ribs which form a plurality of channels therebetween for accepting said left secondary winding section and said right secondary winding section.

10. An ignition coil as in claim 7 wherein said right secondary winding section is coaxial to said left secondary winding section and wherein said right secondary winding section is axially spaced from said left secondary winding section.

11. An ignition coil as in claim 1 wherein said third spark-generating current has about two times the energy as either of said first spark-generating current and said second spark-generating current.

12. An ignition coil as in claim 1 further comprising a ground plane associated with said third terminal.

13. An ignition coil as in claim 12 further comprising:

a first high voltage tower for connection to said first spark plug;

a second high voltage tower for connection to said second spark plug; and a third high voltage tower for connection to said third spark plug;

wherein said ground plane radially surrounds said third high voltage tower.

* * * * *